US008333412B2

(12) United States Patent
Hamblin

(10) Patent No.: US 8,333,412 B2
(45) Date of Patent: Dec. 18, 2012

(54) LOCKER

(75) Inventor: Steven W. Hamblin, Daleville, VA (US)

(73) Assignee: Scranton Products Inc., Scranton, PA (US)

( * ) Notice: Subject to any disclaimer, the term of this patent is extended or adjusted under 35 U.S.C. 154(b) by 703 days.

(21) Appl. No.: 12/505,017

(22) Filed: Jul. 17, 2009

(65) Prior Publication Data

US 2011/0012371 A1 Jan. 20, 2011

(51) Int. Cl.
*E05C 1/12* (2006.01)

(52) U.S. Cl. ..... 292/36; 292/DIG. 68; 292/193

(58) Field of Classification Search ..... 292/9, 23, 292/36, 34, 138–139, 193, 281, DIG. 68, 292/170; 312/216–217, 220
See application file for complete search history.

(56) References Cited

U.S. PATENT DOCUMENTS

| | | | | | |
|---|---|---|---|---|---|
| 461,167 | A | * | 10/1891 | Gaskill | 292/261 |
| 584,753 | A | | 6/1897 | York | |
| 1,070,365 | A | * | 8/1913 | Voight | 292/47 |
| 1,820,715 | A | | 8/1931 | Vance | |
| 1,908,980 | A | * | 5/1933 | Heyel | 70/120 |
| 2,049,939 | A | | 8/1936 | Bales | |
| 2,144,136 | A | * | 1/1939 | Albach | 292/48 |
| 2,183,672 | A | * | 12/1939 | Devereaux | 292/169.12 |
| 2,717,064 | A | * | 9/1955 | Hock | 49/394 |
| 2,835,523 | A | | 5/1958 | Chervenka | |
| 3,158,016 | A | | 11/1964 | Fay | |
| 3,637,246 | A | * | 1/1972 | Leiter | 292/87 |
| 4,058,333 | A | | 11/1977 | Roe et al. | |
| 4,369,993 | A | * | 1/1983 | Rodriguez | 292/148 |
| 4,852,920 | A | * | 8/1989 | DeForrest, Sr. | 292/205 |
| 4,934,800 | A | | 6/1990 | Choi | |
| 5,509,703 | A | | 4/1996 | Lau et al. | |
| 5,671,985 | A | * | 9/1997 | Grieser et al. | 312/221 |
| 5,802,801 | A | * | 9/1998 | Hohns et al. | 52/792.1 |
| 5,865,479 | A | | 2/1999 | Viney | |
| 6,375,244 | B1 | | 4/2002 | Smeltzer | |
| 6,641,183 | B2 | | 11/2003 | Brown | |
| 6,685,285 | B1 | | 2/2004 | Fromme et al. | |
| 6,773,042 | B2 | | 8/2004 | Spurr et al. | |
| 6,793,299 | B2 | | 9/2004 | Newberry et al. | |
| 6,802,543 | B1 | | 10/2004 | Wakefield | |
| 7,029,078 | B1 | | 4/2006 | Fromme et al. | |
| 7,278,695 | B2 | * | 10/2007 | Fromme et al. | 312/217 |
| 2004/0239121 | A1 | | 12/2004 | Morris | |
| 2005/0110279 | A1 | | 5/2005 | Kalsi | |
| 2006/0232175 | A1 | | 10/2006 | Fromme et al. | |
| 2008/0024045 | A1 | | 1/2008 | Heimler et al. | |

* cited by examiner

*Primary Examiner* — Kristina Fulton
(74) *Attorney, Agent, or Firm* — Buchanan Ingersoll & Rooney PC

(57) ABSTRACT

A locker has a latch bar attached to the inside surface of door by projections that extend through respective slots in the bar. The slots are configured to permit the bar to move parallel to the door between an extended position and a retracted position, the extended position being horizontally offset from the retracted position. An actuator plate is positioned between the inside surface of the door and the latch bar and is connected to a handle on the outside surface of the door. The at least one pair of spaced rollers is provided on the actuator plate. A diagonal rib is attached to the latch bar for each pair of rollers. Each diagonal rib is positioned between a respective pair of spaced apart rollers, such that when the handle and actuator plate are moved vertically, each pair of rollers will move along the diagonal rib positioned between that pair of rollers causing the latch bar to move horizontally. The handle preferably has an upper portion that is parallel to the front surface of the door and a lower hand grip portion that extends away from the upper portion.

10 Claims, 4 Drawing Sheets

LOCKER

FIELD OF THE INVENTION

The present invention relates to storage units, namely lockers.

BACKGROUND OF THE INVENTION

Storage units, such as a lockers, are used in schools, factories, health clubs, athletic facilities, parks, aquatic centers, military facilities, police departments, recreation centers, theme parks, transportation facilities (e.g., airports, bus stops, train stations, etc.), and other facilities to enable people to securely store clothing, books and other property. Known storage units typically include a plurality of walls that define a storage space, a door, and a latch mechanism. These components may be made from plastic, metal, or composite materials.

Many lockers have a handle on the door which is moved vertically to release a latch mechanism and allow the door to be moved from a closed position to an open position. The latch mechanism usually includes a bar or lever that engages the locker housing to lock the door. However, some lockers have latch mechanisms in which the latch bar, and sometimes the handle, moves diagonally. An example of such a locker is disclosed in U.S. Pat. No. 2,717,064 and in United States Published Application No. 2006/0232175.

Known storage units may present disadvantages, such as a large amount of material waste generated during fabrication, a large number of parts to assemble the latch mechanism, restrictive tolerances or undue precision required for assembly and installation of the latch mechanism, cost and time burden in assembly, the costs of skilled labor, inspection and occasional repair or quality control during and after assembly or installation, and other problems that tend to be associated with assembling and installing such known storage units.

Accordingly, it would be advantageous to provide a less costly storage unit that is relatively easy to assemble and install. It would also be advantageous to provide a storage unit that can be made of molded plastic components and thereby generate less material waste during manufacture and fabrication.

SUMMARY OF THE INVENTION

I provide locker having a housing defining a rectangular storage space and having an opening. A door is attached to the housing by a hinge adjacent the opening of the housing allowing the door to rotate between an open position and a closed position.

There is a latch bar attached to the inside surface of door by projections that extend through respective slots in the bar. The slots are configured to permit the bar to move parallel to the door between an extended position and a retracted position, the extended position being horizontally offset from the retracted position.

An actuator plate is positioned between the inside surface of the door and the latch bar. The actuator plate is connected to a handle on the outside surface of the door in a manner to permit the actuator plate and the handle to move parallel to the door between an extended position and a retracted position. The extended position is vertically offset from the retracted position. I provide at least one pair of spaced rollers on the actuator plate. There is a diagonal rib attached to the latch bar for each pair of rollers. Each diagonal rib is positioned between a respective one pair of spaced apart rollers, such that when the actuator plate is moved vertically, each pair of rollers will move along the diagonal rib positioned between that pair of rollers causing the latch bar to move horizontally.

I further prefer to provide a handle having a face plate whose upper portion is positioned parallel to the face of the door and whose lower portion angles away from the face plate to provide a place to grasp the handle. I also prefer to provide a slot in the upper portion of the handle. A hasp with a center hole extends from the actuator plate through the slot. The slot is configured so that the handle can move the hasp and thereby move the actuator. A small plate having a center hole extends from the front of the door and is parallel to the hasp. When the handle is in a closed position the holes in the hasp and the small plate on the door are aligned such that a padlock can pass through the holes preventing the handle and actuator from moving and opening the locker.

I prefer to make the handle from molded plastic and can mold the lower portion of the handle to be soft or flexible making the handle more comfortable to grasp.

Other features and advantages of the locker of the present invention will become apparent from certain preferred embodiments shown in the figures.

BRIEF DESCRIPTION OF THE PREFERRED EMBODIMENTS

DESCRIPTION OF THE PREFERRED EMBODIMENTS

Figure 1:
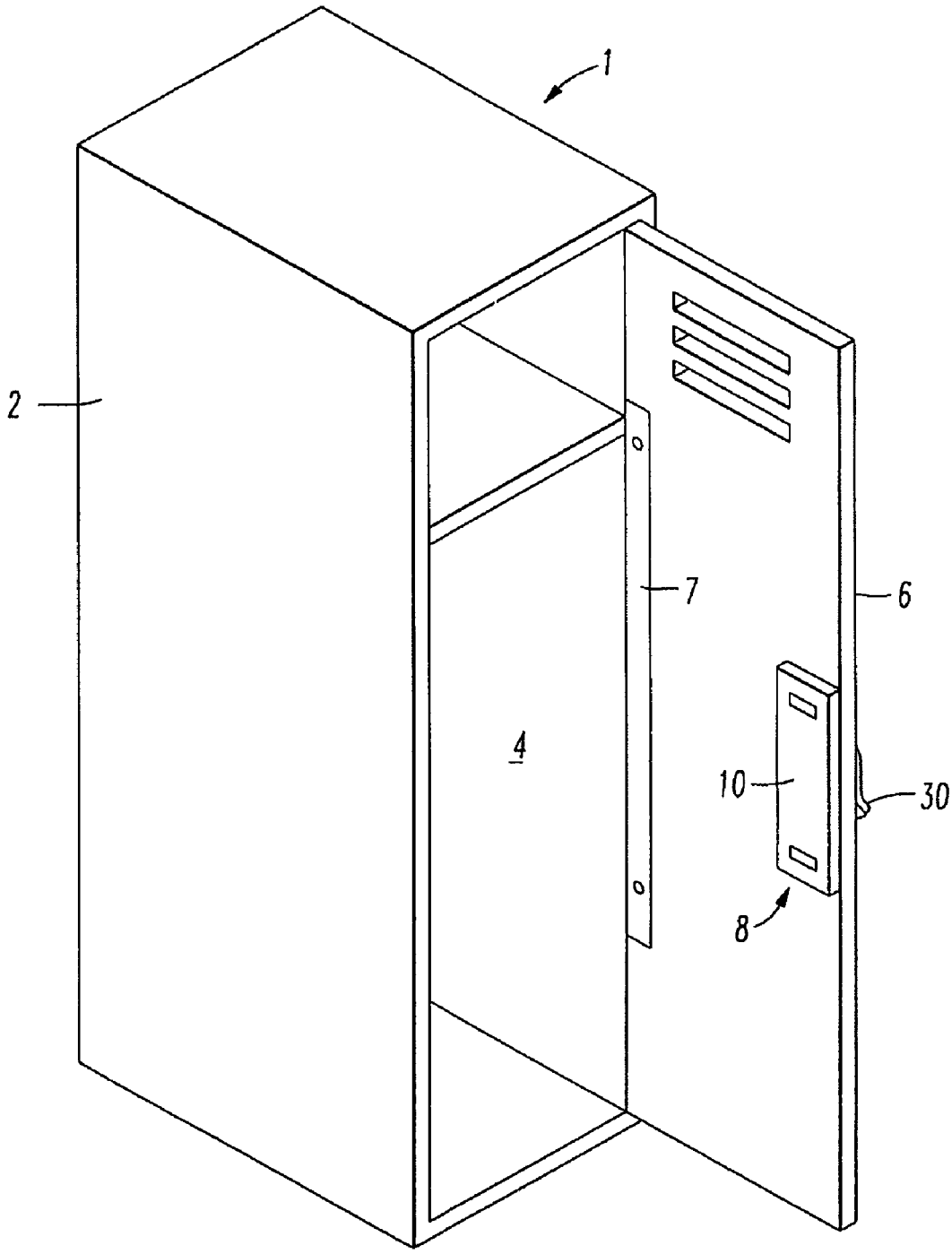
FIG. 1 is a perspective view of a present preferred embodiment of my locker.

I provide a locker 1 shown in FIG. 1 which has a housing 2 that defines a generally rectangular storage space 4. A door 6 is attached to the housing by hinge 7. A latch mechanism 8 is provided on the door 6. The latch mechanism is operated by a handle 30 on the outside surface of the door 6.

Figure 2:
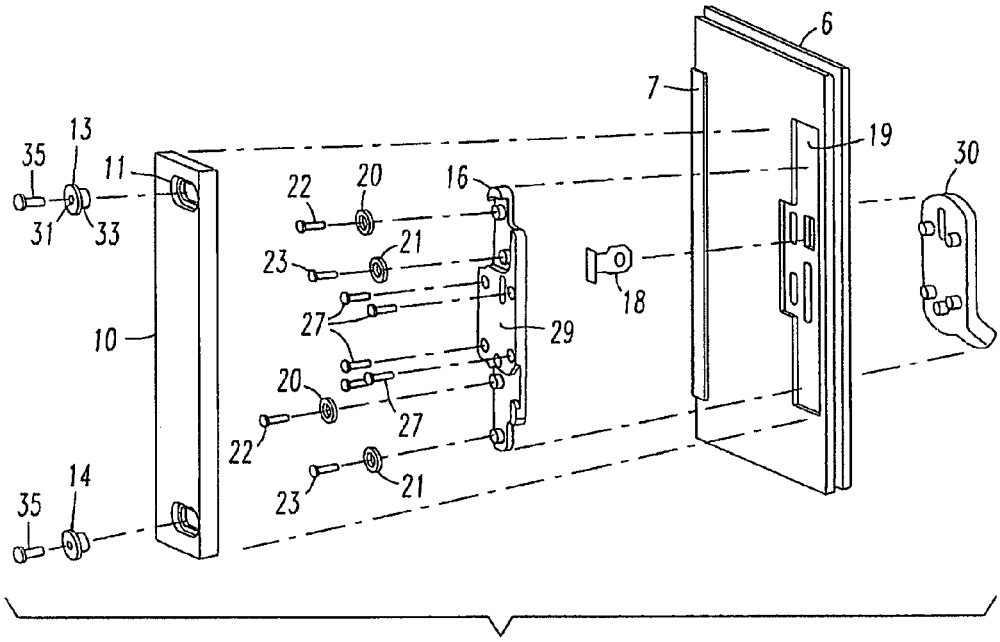
FIG. 2 is an exploded view of the door and latch mechanism in the locker shown in FIG. 1.
Figure 3:
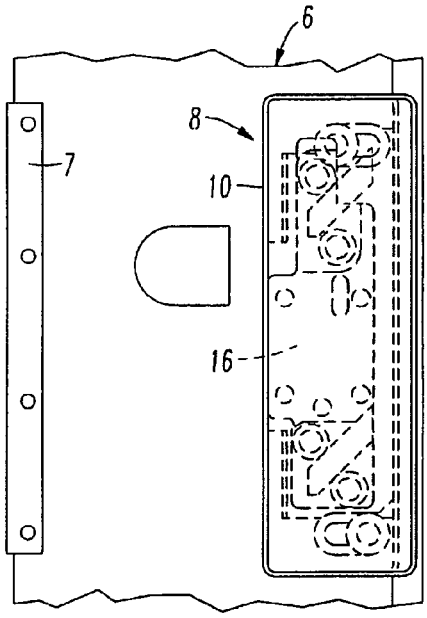
FIG. 3 is a plan view of the inside of the door showing the latch mechanism in a locked position.
Figure 4:
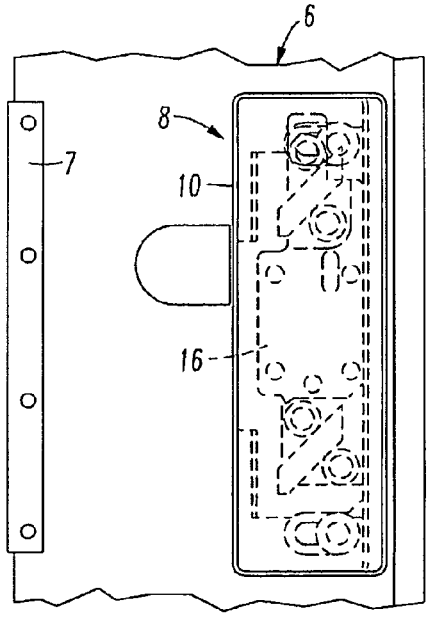
FIG. 4 is a plan view of the door shown in FIG. 2 showing the latch mechanism in an unlocked position.

The latch mechanism is shown in exploded view in FIG. 2. We provide a latch bar 10 which is held on the inside of the door by a pair of rollers 13, 14. Each roller has an elongated body 33 that fits through a slot 11, 12 in the latch bar. The roller has an enlarged head 31 having a diameter greater than the width of the slots. Rivets 35 are provided to attach the rollers to the inside surface of the door 6. As can be seen in FIGS. 2 through 4, the rivets 35 are attached to the door 6 and form projections on the inside surface of the door 6 which hold the rollers 13, 14.

I further provide an actuator plate 16 positioned between the inside surface of the door 6 and the latch bar 10. A hasp 18 extends from the actuator 16 through a slot 19 in the door and through a second slot 31 in the handle 30. Pins 27 connect the actuator plate to the handle 30 so that movement of the handle 30 in a vertical direction will cause a corresponding movement of the actuator plate 16. I further provide two pairs of rollers 20 and 21 which are attached to the actuator plate by axles 22 and 23.

Figure 5:
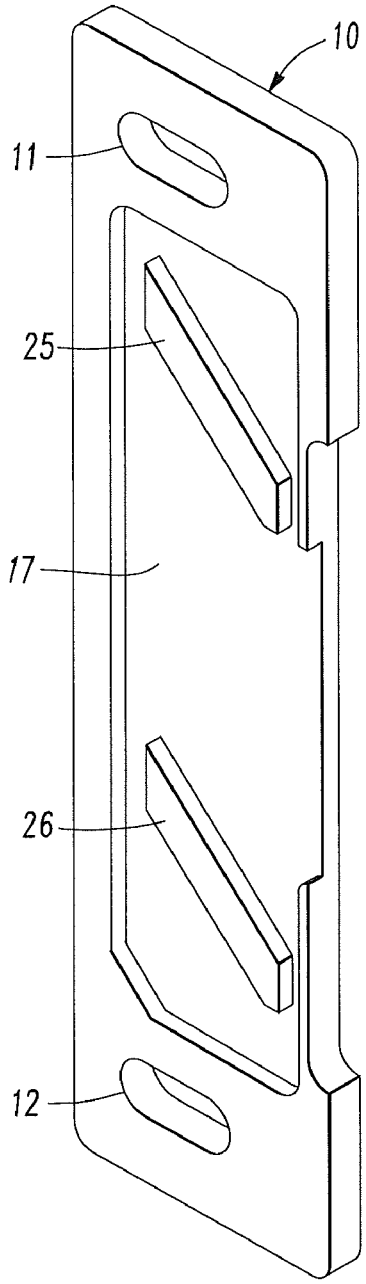
FIG. 5 is a perspective view of a present preferred latch bar in the embodiment of FIG. 1.
Figure 6:
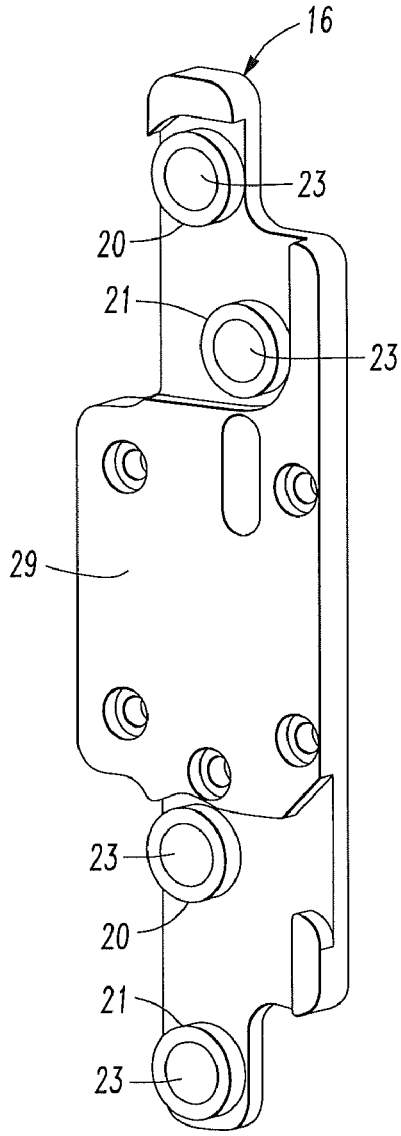
FIG. 6 is a perspective view of a present preferred actuator plate.

As seen most clearly in FIG. 5, I provide a pair of diagonal ribs 25 and 26 on the inside surface of the latch bar 10. These ribs fit between a respective pair of rollers 20, 21. Consequently, vertical movement of the actuator plate will cause the diagonal ribs to ride along the rollers resulting in horizontal movement of the latch bar 10. Although I prefer to provide two diagonal ribs 25 and 26, one could omit either diagonal rib 25 or diagonal rib 26 and the rollers associated with the omitted rib such that the actuator plate will travel on only on rib.

FIGS. 3 and 4 show the latch mechanism 8 on the inside surface of the door. In FIG. 3, the latch bar and the actuator plate are in an extended or closed position. Vertical movement of the handle will cause the actuator plate to move upward to an open or retracted position. As a result, the diagonal ribs in the latch bar travel on the rollers causing the latch bar to move from the closed position to an open or retracted position shown in FIG. 4. The rollers reduce the friction in the system and create a smooth action. In FIGS. 3 and 4 the ribs 25, 26 and the actuator plate 16 are illustrated in phantom line so that this action can be more readily seen.

All of the major components of the locker can be molded from plastic material. I prefer to use high density polyethylene. Of course, one could make any of the components from metal or a composite material. But, using plastic reduces waste and cost of manufacture.

I further prefer to provide a recess 17 in the latch bar such that the rollers 20 and 21 on the actuator plate will fit within the recess. The recess provides a thinner profile to the latch mechanism and results in the use of less material.

In my latch mechanism, my handle moves exclusively vertically. This permits easier integration of a coin lock or combination lock (not shown) into the locker.

Figure 7:
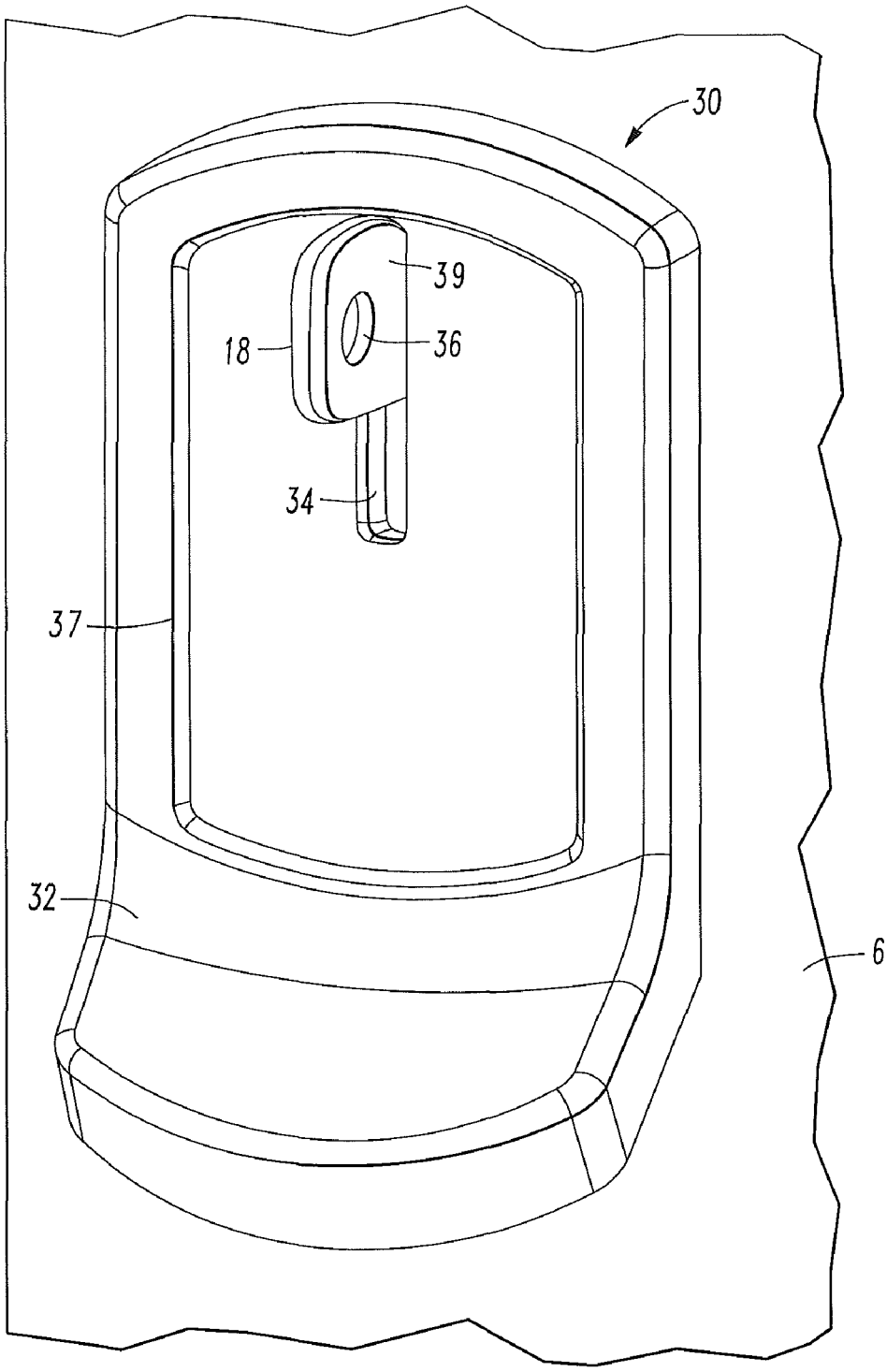
FIG. 7 is a front perspective fragmentary view showing a portion of the door and present preferred handle on the door.

While any number of handles can be used in my locker, I prefer to use the handle 30 shown in FIG. 7. This handle 30 has a face plate having an upper portion 37 positioned parallel to the face of the door and a lower portion 32 that extends away from the upper portion to provide a place to grasp the handle. There is a slot 34 in the upper portion of the handle. The hasp 18 passes through that slot. Also passing though that slot is a tab 39 that is attached to the front of the door. Both the hasp 18 and the tab 39 have a center hole 36. When the handle is in a closed position the holes in the hasp and the tab 39 are aligned such that a padlock can pass through the holes preventing the handle from moving and opening the locker. When the padlock is used the padlock will be above the lower portion of the handle such that there is easy access to the lock. Moreover neither the tab extending from the door not the hasp extending from the actuator interfere with the lower portion of the handle where gripping of the handle occurs.

I prefer to make the handle 30 of molded plastic. I can mold the lower portion 32 of the handle to be soft or flexible making the handle more comfortable to grasp.

While I have shown and described the present preferred embodiment of my locker and latch mechanism, it should be distinctly understood that the invention is not limited thereto but may be variously embodied within the scope of the following claims.

I claim:

1. A locker comprising:

a housing defining a rectangular storage space and having an opening;

a door attached to the housing by a hinge adjacent the opening of the housing and configured to rotate between an open position and a closed position, the door having an inside surface and an outside surface;

at least one projection extending from the inside surface of the door;

a bar attached to the door, the bar having at least one slot through which the at least one projection extends, the at least one slot configured to permit the bar to move parallel to the door between an extended position and a retracted position, the extended position being horizontally offset from the retracted position;

an actuator plate positioned between the inside surface of the door and the bar, the actuator plate having a hasp extending from the actuator and passing through a slot in the door, the slot configured to permit the actuator plate to move parallel to the door between an extended position and a retracted position, the extended position being vertically offset from the retracted position;

at least one pair of spaced rollers attached to the actuator plate; and at least one diagonal rib attached to the bar, each diagonal rib positioned between a respective one pair of the at least one pair of spaced apart rollers, such that when the actuator plate is moved vertically, each pair of rollers will move along the diagonal rib positioned between that pair of rollers causing the bar to move horizontally.

2. The locker of claim 1 wherein the at least one pair of rollers is comprised of two pairs of rollers.

3. The locker of claim 2 wherein the two pairs of rollers are a first pair of rollers positioned above a second pair of rollers.

4. The locker of claim 1 also comprising a handle connected to the actuator plate and positioned adjacent the outside surface of the door.

5. The locker of claim 4 wherein the handle is comprised of an upper portion and a lower portion that extends away from the upper portion.

6. The locker of claim 4 wherein the handle is plastic.

7. The locker of claim 4 wherein the upper portion of the handle has a slot through which the hasp passes and also comprising a tab parallel to the hasp, attached to the front surface of the door and extending through the slot in the upper portion of the handle.

8. The locker of claim 1 wherein the housing and the door are metal or plastic.

9. The locker of claim 1 wherein at least one of the housing and the door are made from high density polyethylene.

10. The locker of claim 1 wherein the at least one projection is comprised of an elongated body that fits through the at least one slot in the latch bar and a head having a diameter greater than a width of the slot and attached to a distal end of the at least one projection.

* * * * *